US006669050B2

(12) United States Patent
Yu

(10) Patent No.: US 6,669,050 B2
(45) Date of Patent: Dec. 30, 2003

(54) PAPER CURRENCY STORAGE CABINET MOUNTING ARRANGEMENT FOR A PAPER CURRENCY RECEIVING SYSTEM USED IN A TICKET VENDOR OR THE LIKE

(75) Inventor: Cheng-Kang Yu, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 71 days.

(21) Appl. No.: 10/122,202

(22) Filed: Apr. 16, 2002

(65) Prior Publication Data

US 2003/0192904 A1 Oct. 16, 2003

(51) Int. Cl.[7] ..... A47F 1/04
(52) U.S. Cl. ..... 221/154; 312/215
(58) Field of Search ..... 221/154, 197, 221/7, 9, 13; 312/215, 216; 194/205; 902/9, 13

(56) References Cited

U.S. PATENT DOCUMENTS 4,370,006 A * 1/1983 Graef et al. ..... 312/215
4,903,815 A * 2/1990 Hirschfeld et al. ..... 194/205

* cited by examiner

*Primary Examiner*—Kenneth W. Noland
(74) *Attorney, Agent, or Firm*—Rabin & Berdo, P.C.

(57) ABSTRACT

A paper currency storage cabinet mounting arrangement is constructed to include a paper currency receiving and verification unit and a paper currency storage cabinet, the paper currency receiving and verification unit having retaining holes and a hook hole, the paper currency storage cabinet having retaining rods disposed at two sides and a spring-supported lock means disposed at one end, the spring-supported lock means being automatically forced into the hook hole to lock the paper currency receiving and verification unit and the paper currency storage cabinet when the respective retaining rods respectively engaged into the respective retaining holes.

5 Claims, 6 Drawing Sheets

PAPER CURRENCY STORAGE CABINET MOUNTING ARRANGEMENT FOR A PAPER CURRENCY RECEIVING SYSTEM USED IN A TICKET VENDOR OR THE LIKE

BACKGROUND OF THE INVENTION

1. Field of the Invention

The present invention relates to a paper currency receiving system for use in a ticket vending machine, money exchange machine, or the like and, more particularly to a paper currency storage cabinet mounting arrangement for a paper currency receiving system used in a ticket vendor or the like, which enables the paper currency storage cabinet to be conveniently detachably fastened to the paper currency receiving and verification unit.

2. Description of the Related Art

A variety of ticket vending machines have been disclosed, and intensively used in parking lots, stations, public facilities for receiving paper currency and vending tickets. A regular ticket vending machine comprises a paper currency receiving and verification unit adapted for receiving and verifying the authenticity of paper currency inserted therein, and a paper currency storage cabinet adapted for receiving verified paper currency transferred from the paper currency receiving and verification unit. FIG. 4 is an exploded view of a paper currency storage cabinet for a paper currency receiving system used in a ticket vending machine. The paper currency storage cabinet comprises a swinging door panel, conical springs fixedly provided on the inside, and a pressure board supported on the conical springs and adapted for holding down paper currency received from the paper currency receiving and verification unit. The paper currency storage cabinet has a plurality of retaining rods symmetrically disposed at two sides and adapted for engaging into respective retaining holes in the paper currency receiving and verification unit. This structure of paper currency storage cabinet is still not satisfactory in function. When installed in the paper currency receiving and verification unit, the paper currency storage cabinet tends to be biased by an external force during transfer of paper currency from the paper currency receiving and verification unit to the paper currency storage cabinet, causing paper currency unable to be smoothly stably transferred to the inside of the paper currency storage cabinet.

SUMMARY OF THE INVENTION

The present invention has been accomplished to provide a paper currency storage cabinet mounting arrangement, which eliminates the aforesaid problem. It is the main object of the present invention to provide a paper currency storage cabinet mounting arrangement, which positively locks the paper currency storage cabinet and the paper currency receiving and verification unit against vibration after installation of the paper currency storage cabinet in the paper currency receiving and verification unit. According to one aspect of the present invention, the paper currency receiving and verification unit has a hook hole in one end thereof; the paper currency storage-cabinet has spring-supported lock means provided at one end of a swinging door thereof. When the paper currency storage cabinet loaded in the paper currency receiving and verification unit, the spring-supported lock means is automatically forced into position to lock the paper currency receiving and verification unit and the paper currency storage cabinet. According to another aspect of the present invention, the paper currency receiving and verification unit has L-shaped retaining holes symmetrically provided at two sides, and the paper currency storage cabinet has retaining rods symmetrically disposed at two sides and adapted for engaging the L-shaped retaining holes of the paper currency receiving and verification unit.

DETAILED DESCRIPTION OF THE PREFERRED EMBODIMENT

Figure 1:
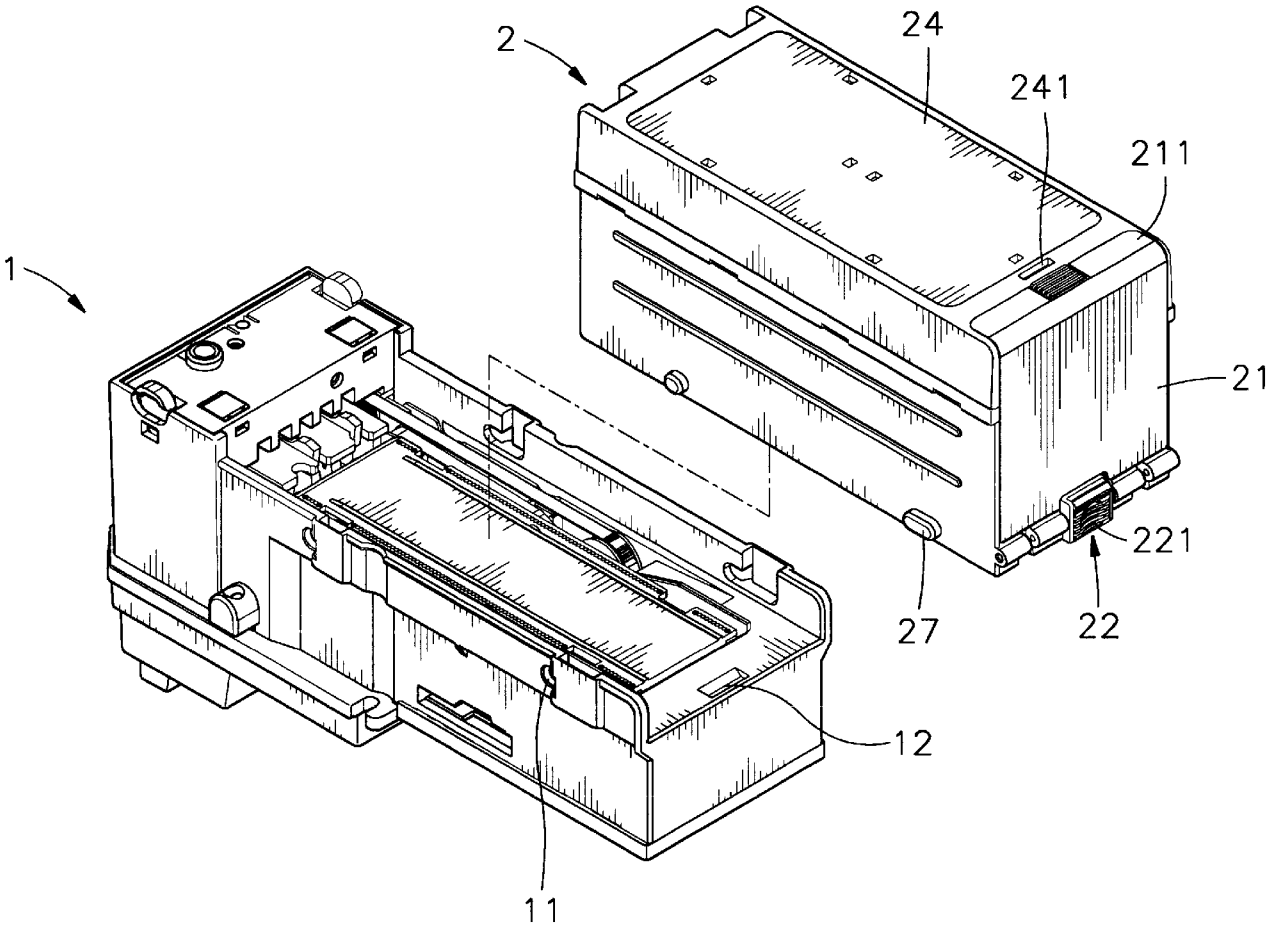
FIG. 1 is an exploded view of the present invention.
Figure 2:
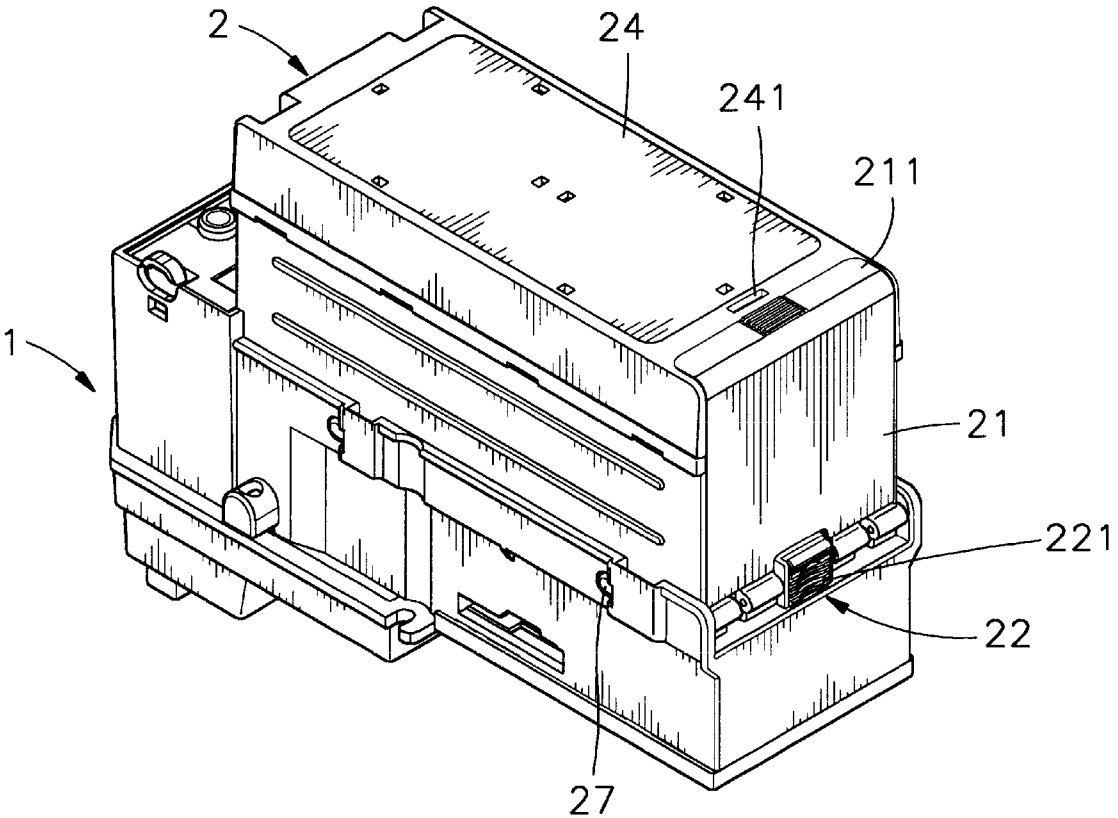
FIG. 2 is an elevational assembly view of the present invention.
Figure 3:
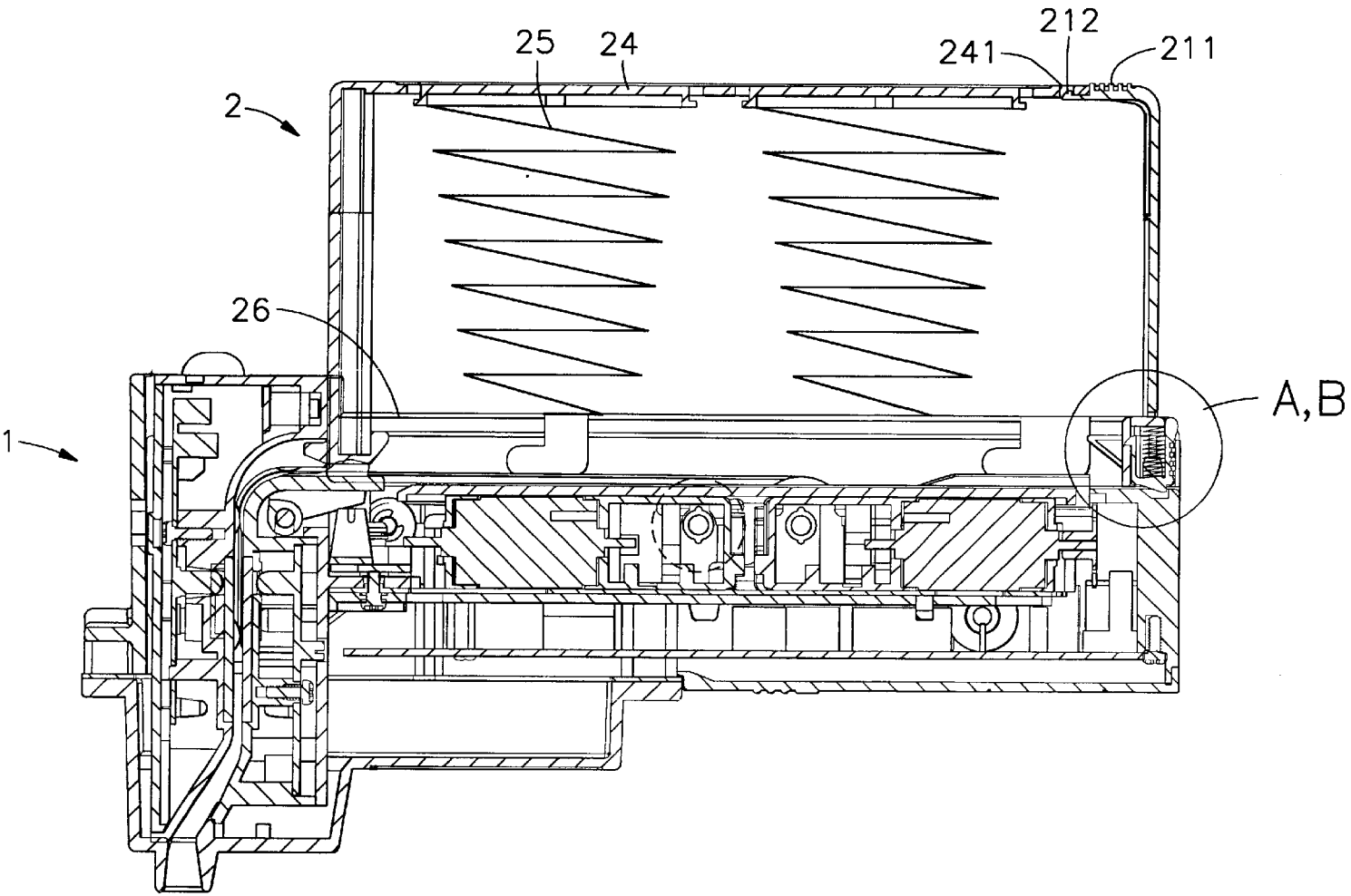
FIG. 3 is a sectional view of the present invention.

Referring to FIGS. 1, 2, and 3, a paper currency receiving system is shown comprised of a paper currency receiving and verification unit 1, and a paper currency storage cabinet 2 fastened to the paper currency receiving and verification unit 1. The paper currency receiving and verification unit 1 detects the authenticity of paper currency inserted therein, and transfers verified paper currency to the paper currency storage cabinet 2. The paper currency storage cabinet 2 comprises a swinging door panel 21, and a locking device 22 provided at one end of the swinging door panel 21 for locking the paper currency storage cabinet 2 when installed in the paper currency receiving and verification unit 1. The locking device 22 comprises a sliding locking block 221 adapted for engaging into a lock hole 12 in the paper currency receiving and verification unit 1, and a spring member, for example, a spiral spring 223 adapted for forcing the sliding locking block 221 into the lock hole 12. The sliding locking block 221 comprises a positioning rod 222 adapted for holding the spring 223, a stop rod 224 adapted for limiting the moving distance of the sliding locking block 221, a handle 225 through which the sliding locking block 221 is moved between the locking position and the unlocking position, and a front engagement portion 226 adapted for engaging the lock hole 12. The front engagement portion 226 has a sloping guide face 2261 adapted for guiding the front engagement portion 226 into the lock hole 12. The swinging door panel 21 has an opposite end provided with a push plate 211. The push plate 211 has a hooked portion 212 adapted for hooking in a hook hole 241 of a back cover 24 of the paper currency storage cabinet 2. Further, compression springs 25 are provided at the inner sidewall of the back cover 24 to support a pressure board 26 for holding down paper currency transferred from the paper currency receiving and verification unit 1.

Referring to FIGS. 1 and 3 again, the paper currency receiving cabinet 2 further comprises a plurality of retaining rods 27 adapted for engaging respective L-shaped retaining holes 11 in two opposite lateral sidewalls of the paper currency receiving and verification unit 1.

Figure 3A:
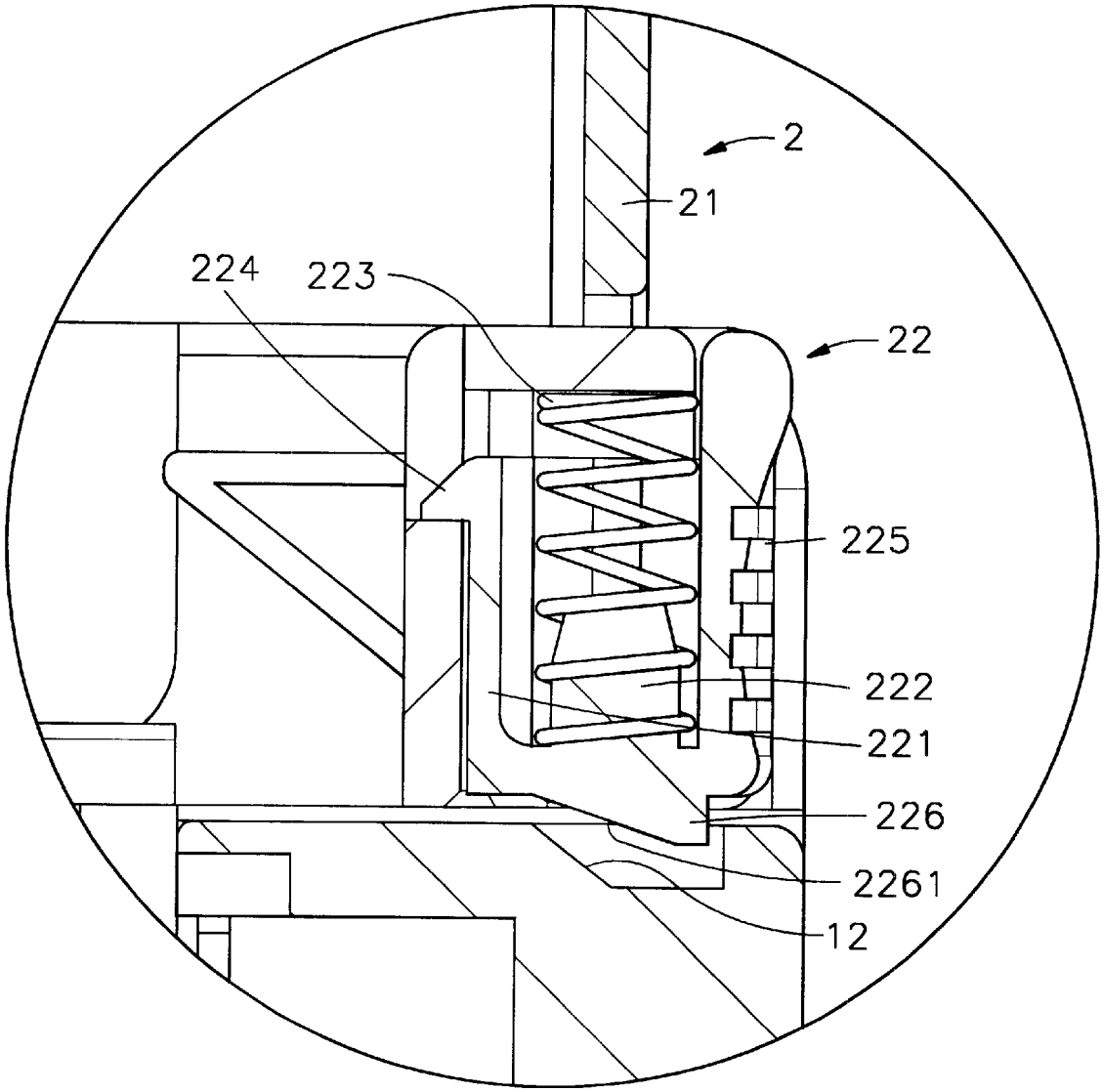
FIG. 3A is an enlarged view of part A of FIG. 3.
Figure 3B:
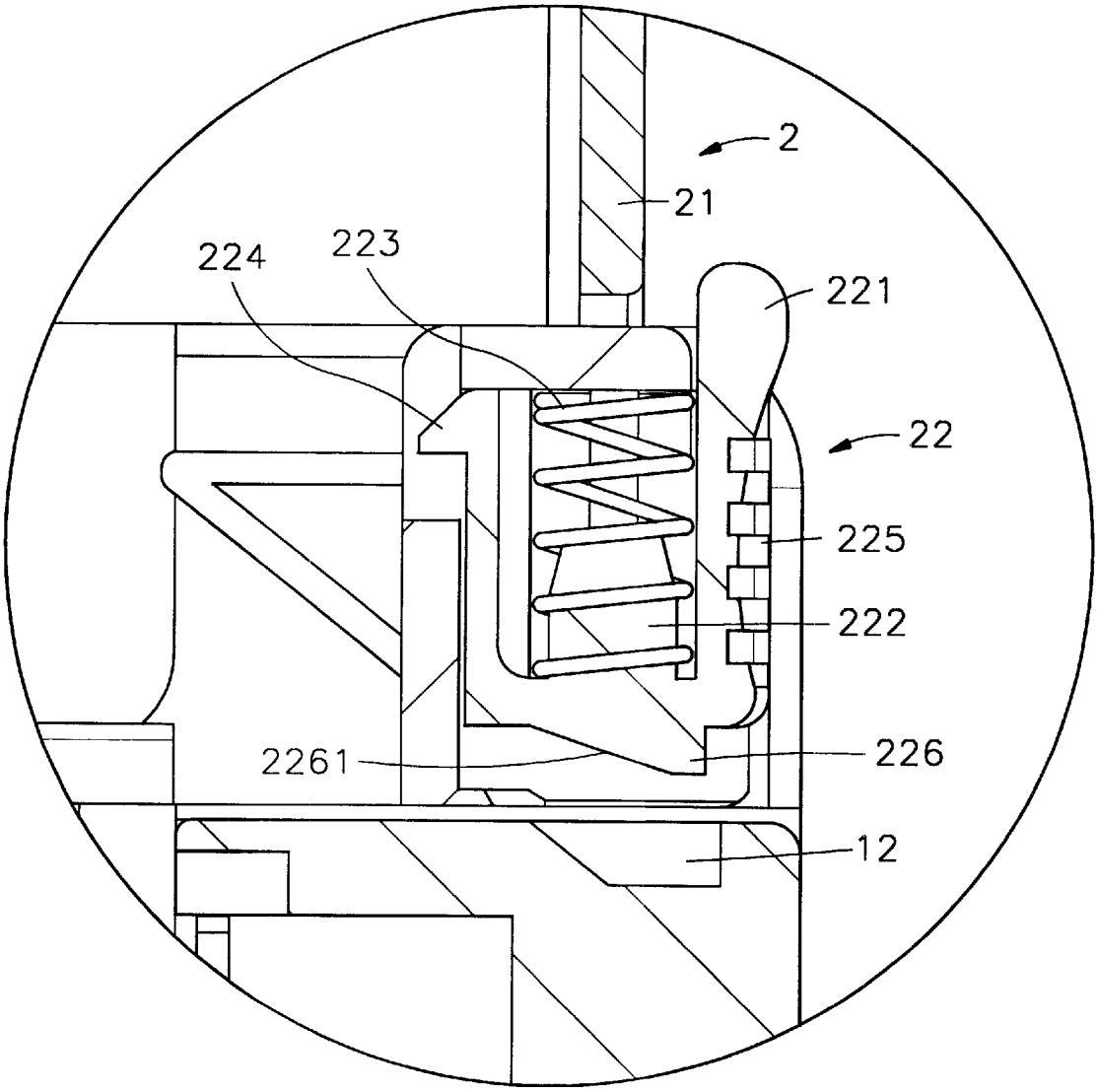
FIG. 3B is an enlarged view of part B of FIG. 3.
Figure 4:
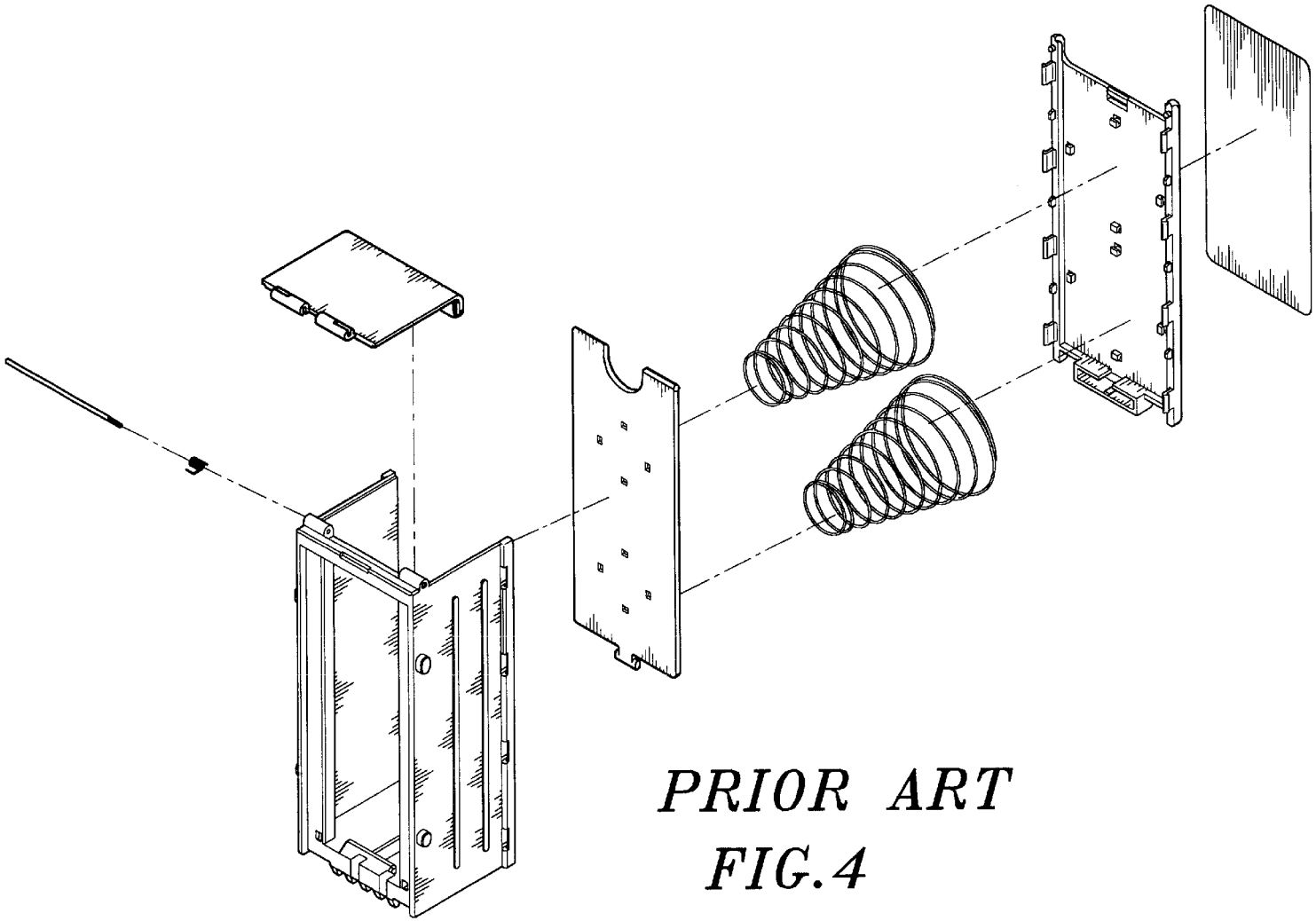
PRIOR ART FIG. 4
FIG. 4 is an exploded view of the prior art design.

Referring to FIGS. 3, 3A, and 3B, when separating the paper currency storage cabinet 2 from the paper currency receiving and verification unit 1, move the handle 225 to force the sliding locking block 221 against the spring 223 and to disengage the front engagement portion 226 from the lock hole 12, and then push the paper currency storage cabinet 2 outwards to disengage the retaining rods 27 from the L-shaped retaining holes 11 while holding the handle 225 is the unlocking position, and therefore the paper currency storage cabinet 2 is separated from the paper currency receiving and verification unit 1. When reloading the paper currency storage cabinet 2 in the paper currency receiving and verification unit 1, insert the respective retaining rods 27 into the respective L-shaped retaining holes 11, and the sliding locking block 221 is automatically forced by the spring 223 to engage the front engagement portion 226 into the lock hole 12 when the paper currency storage cabinet 2 set into position in the paper currency receiving and verification cabinet 1.

A prototype of paper currency storage cabinet mounting arrangement has been constructed with the features of the annexed drawings of FIGS. 1~3. The paper currency storage cabinet mounting arrangement functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A paper currency storage cabinet mounting arrangement comprising a paper currency receiving and verification unit adapted for detecting the authenticity of paper currency inserted therein, and transferring verified paper currency to a paper currency storage cabinet, and a paper currency storage cabinet detachably secured to said paper currency receiving and verification unit and adapted for receiving verified paper currency from said paper currency receiving and verification unit, wherein said paper currency receiving and verification unit comprises a lock hole; said paper currency storage cabinet comprises a locking device for engaging into the lock hole of said paper currency receiving and verification unit to lock said paper currency storage cabinet and said paper currency receiving and verification unit, said locking device comprising a sliding locking block adapted for engaging into the lock hole of said paper currency receiving and verification unit, and a spring member adapted for forcing said sliding locking block into engagement with the lock hole of said paper currency receiving and verification unit, said sliding locking block comprising a positioning rod adapted for holding said spring member, a stop rod adapted for limiting the moving distance of said sliding locking block in said paper currency storage cabinet, a handle through which said sliding locking block is moved between the locking position and the unlocking position, and a front engagement portion adapted for engaging the lock hole of said paper currency receiving and verification unit.

2. The paper currency storage cabinet mounting arrangement as claimed in claim 1, wherein said spring member is a spiral spring.

3. The paper currency storage cabinet mounting arrangement as claimed in claim 1, wherein said paper currency storage cabinet comprises a plurality of retaining rods symmetrically protruded from two opposite lateral sidewalls thereof; said paper currency receiving and verification unit comprises a plurality of retaining holes symmetrically disposed in two opposite lateral sidewalls thereof and adapted for receiving the retaining rods of said paper currency storage cabinet.

4. The paper currency storage cabinet mounting arrangement as claimed in claim 3, wherein said retaining holes of said paper currency receiving and verification unit are L-shaped.

5. The paper currency storage cabinet mounting arrangement as claimed in claim 1, wherein the locking device of said paper currency storage cabinet is provided at one end of a swinging door panel of said paper currency storage cabinet, said swinging door panel having an opposite end provided with a push plate, said push plate having a hooked portion adapted for hooking in a hook hole of a back cover of said paper currency storage cabinet.

* * * * *